US008302999B2

(12) United States Patent
Xu

(10) Patent No.: US 8,302,999 B2
(45) Date of Patent: Nov. 6, 2012

(54) FAUCET CONNECTING STRUCTURE

(75) Inventor: Jianhui Xu, Shen Zen (CN)

(73) Assignee: Globe Union Industrial Corp., Taichung (TW)

( * ) Notice: Subject to any disclaimer, the term of this patent is extended or adjusted under 35 U.S.C. 154(b) by 178 days.

(21) Appl. No.: 12/848,164

(22) Filed: Jul. 31, 2010

(65) Prior Publication Data

US 2012/0025520 A1 Feb. 2, 2012

(51) Int. Cl.
*F16L 21/00* (2006.01)

(52) U.S. Cl. ..... 285/8; 285/276; 285/321; 285/921; 137/801

(58) Field of Classification Search ..... 285/8, 275–282, 285/273, 321, 319, 305, 921; 137/801, 359; 4/678; 74/504
See application file for complete search history.

(56) References Cited

U.S. PATENT DOCUMENTS 4,592,388 A * 6/1986 Wilcox ..... 137/615
5,873,387 A * 2/1999 Weber et al. ..... 137/615
2003/0062722 A1* 4/2003 Linhart ..... 285/319

* cited by examiner

*Primary Examiner* — James Hewitt
*Assistant Examiner* — Jay R Ripley

(57) ABSTRACT

A faucet connecting structure contains a body including a chamber having a receiving trench, the receiving trench including an opening; an outlet pipe including a first end to input water and a second end to output water, the first end including a connector inserted into the receiving trench; an engaging member including a peripheral fringe, an inner surface, an outer surface, a first and a second segments, a slot, and the inner and the outer surfaces including at least one first deformable area and at least one second deformable area respectively to generate a radial-direction deformation when being forced in a radial direction so as to act against a radial-direction engaging force resulting from connecting the first engaging member and body together; a retaining means to retain the engaging member and the body together so that the outlet pipe is limited to move and rotate axially relative to the body.

2 Claims, 19 Drawing Sheets

FAUCET CONNECTING STRUCTURE

BACKGROUND OF THE INVENTION

1. Field of the Invention

The present invention relates to a faucet connecting structure.

2. Description of the Prior Art

An outlet pipe and a body of a conventional facet are fitted with each other and then welded together, however a welding connection will generate weld craters to be ground and polished further, have poor appearance and high production cost.

To solve above-mentioned defects, an improved connecting method is developed to control a working precision of a connection of the outlet pipe and the body of the conventional facet. Nevertheless, such an improved connecting method of the outlet pipe and the body has to be kept at a certain connecting precision so as to connect the outlet pipe and the body well, having high production cost.

The present invention has arisen to mitigate and/or obviate the afore-described disadvantages.

SUMMARY OF THE INVENTION

The primary object of the present invention is to provide a faucet connecting structure which is capable of overcoming the shortcomings of the conventional faucet connecting structure.

Secondary object of the present invention is to provide a faucet connecting structure that the engaging member is used to connect the body and the outlet pipe together without using a welding method so as to enhance aesthetics appearance and to facilitate disassembly.

Further object of the present invention is to provide a faucet connecting structure that the engaging member is forced to deform flexibly so as to eliminate a slit between the body and the outlet pipe and to connect the body and the outlet pipe tightly, therefore a working precision of related components for matching with the body and the outlet pipe are lowered to decrease production cost.

Another object of the present invention is to provide a faucet connecting structure that the retaining means serves to retain the outlet pipe on the engaging member so that the outlet pipe do not vibrate and is prevented from moving and rotating axially relative to the body, thus connecting the outlet pipe and the body together securely.

To obtain the above objectives, a faucet connecting structure provided by the present invention comprises a body including a chamber, and the chamber including a receiving trench disposed on a top end thereof, the receiving trench including an opening mounted on a top end thereof; an outlet pipe including an inlet end to input water and an outlet end to output water, and the first inlet end including a connector to be inserted into the receiving trench from the opening of the body, the connector including a first recess formed thereon;

an engaging member made of flexible material and including a peripheral fringe, an inner surface formed on an inner side of the peripheral fringe, an outer surface arranged on an outer side of the peripheral fringe, a first and a second ends disposed on two ends of the peripheral fringe respectively, a slot axially extending from the first end to the second end and allowing to be expanded resiliently and then recovery its original shape, the inner and the outer surfaces including at least one first deformable area and at least one second deformable area respectively to generate a radial-direction deformation when being forced in a radial direction so as to act against a radial-direction engaging force resulting from connecting the first engaging member and body together;

a retaining means to retain the engaging member and the body together so that the outlet pipe is limited to move and rotate axially relative to the body.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 7:
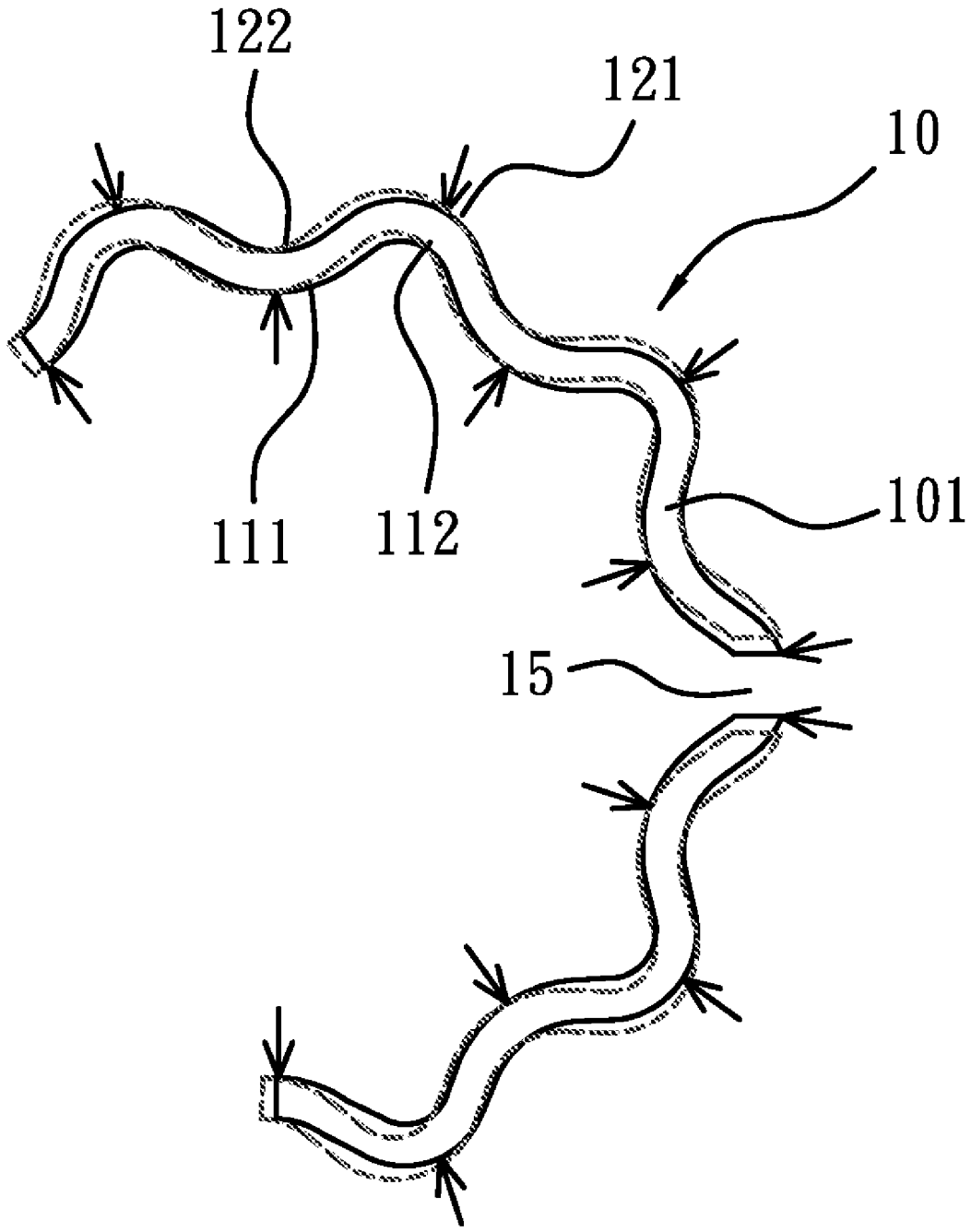
FIG. 7 is a plan view showing first and second deformable areas of the engaging member being forced to deform according to the first embodiment of the present invention.
Figure 8:
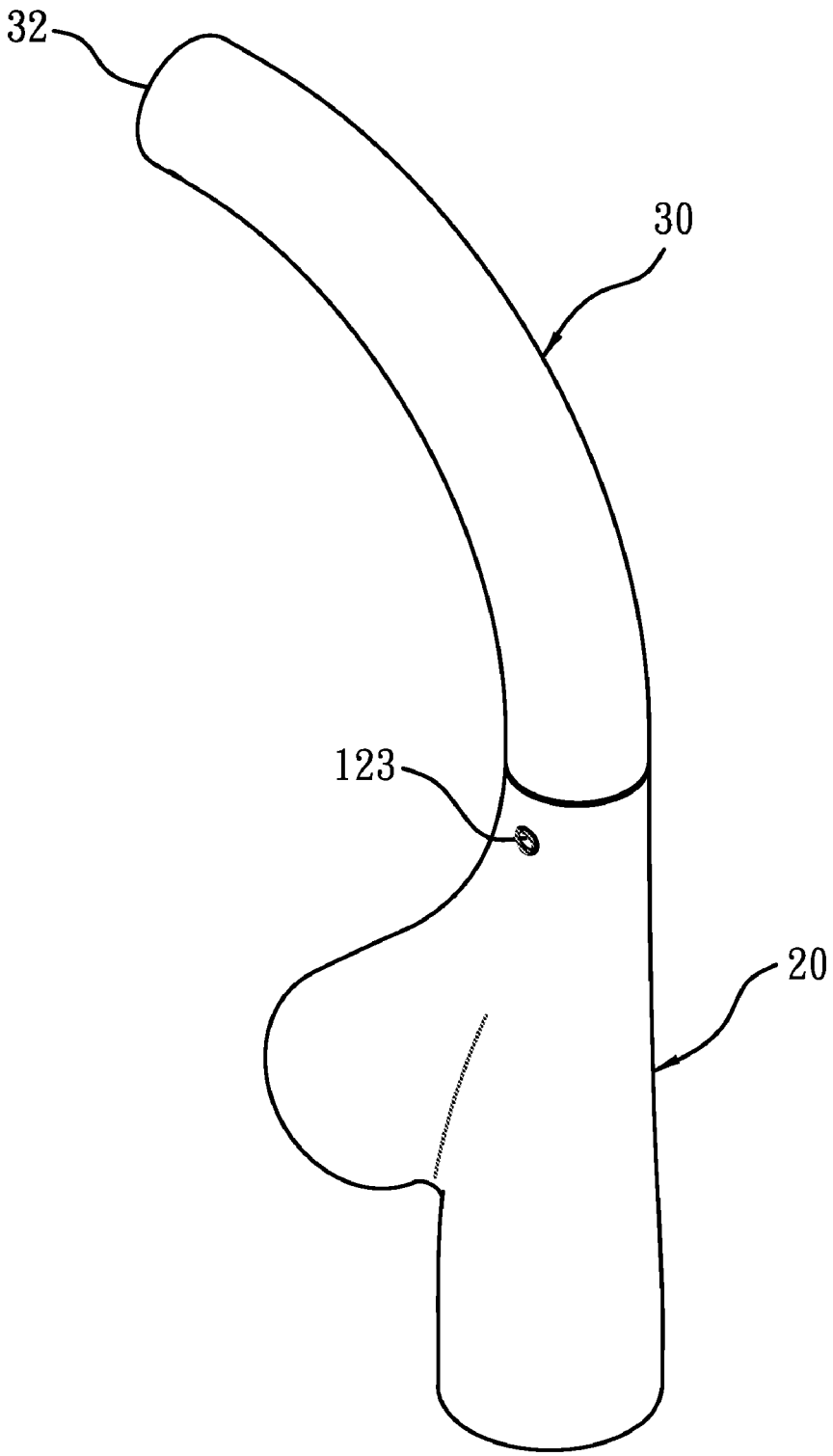
FIG. 8 is a perspective view showing the assembly of the faucet connecting structure according to the first embodiment of the present invention.
Figure 9:
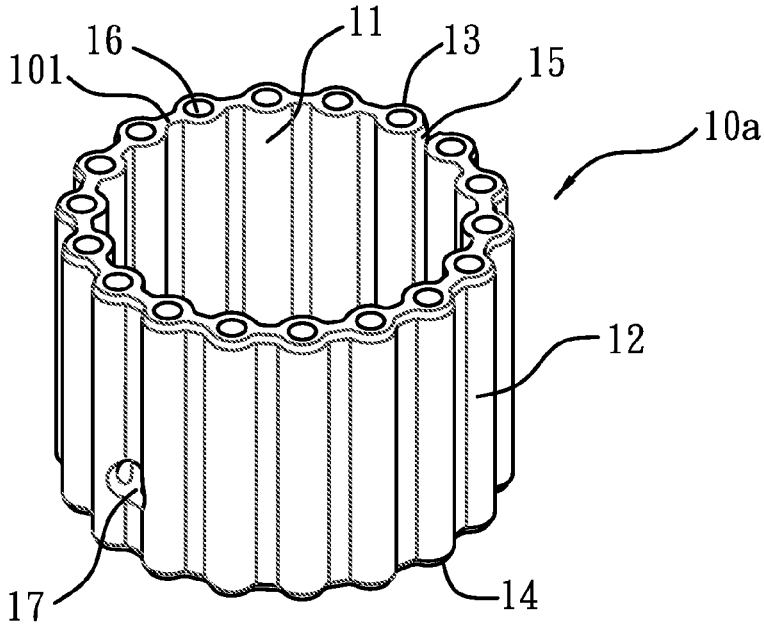
FIG. 9 is a perspective view showing the assembly of an engaging member of a faucet connecting structure according to a second embodiment of the present invention.
Figure 10:
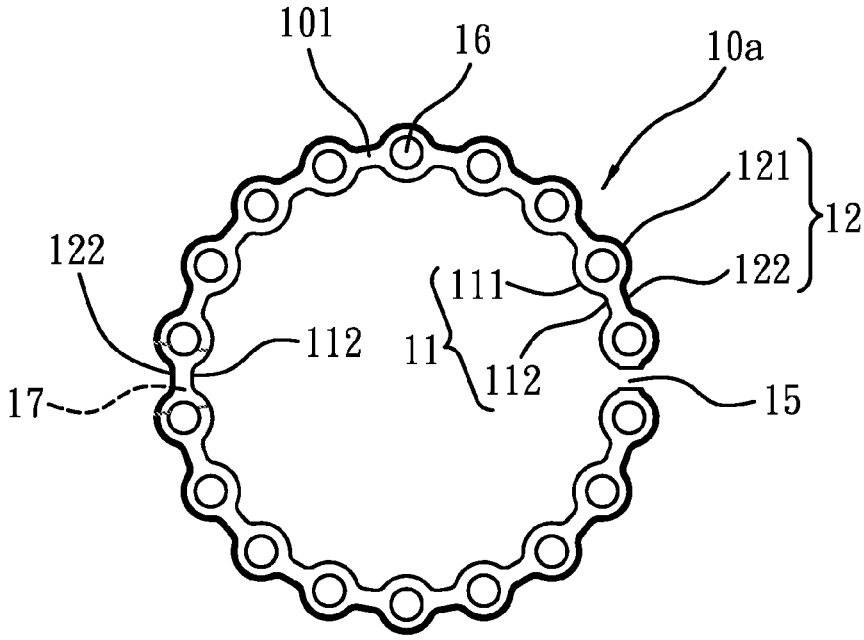
FIG. 10 is a top plan view showing the assembly of the engaging member of the faucet connecting structure according to the second embodiment of the present invention.
Figure 11:
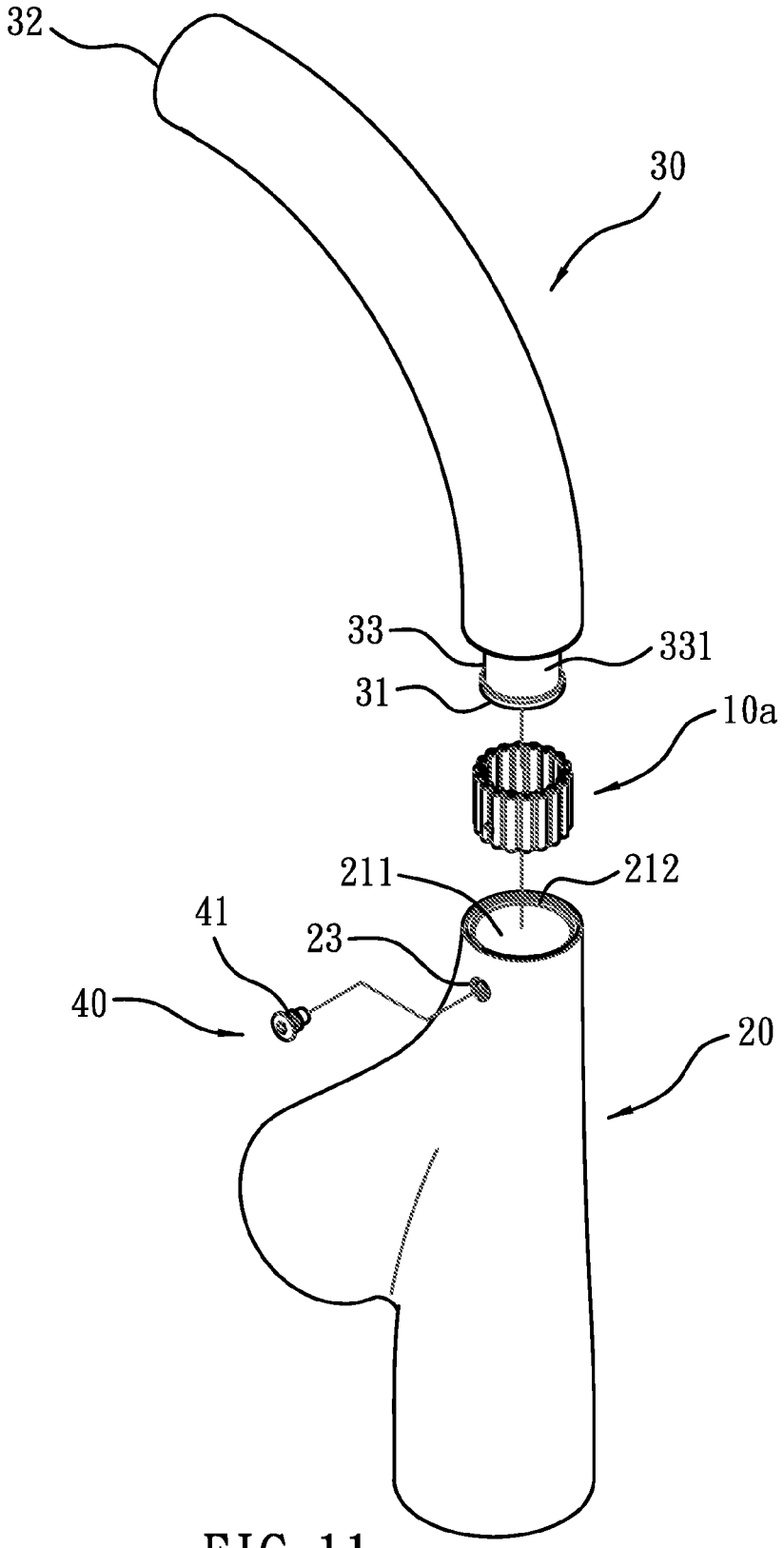
FIG. 11 is a perspective view showing the exploded components of the faucet connecting structure according to the second embodiment of the present invention.

Referring to FIGS. 1-3 and 8, a faucet connecting structure according to a first embodiment of the present invention comprises an engaging member 10, a body 20, and an outlet pipe 30, wherein the engaging member 10 is made of flexible material, and the flexible material is selected from rubber and plastics, and the engaging member 10 includes a peripheral fringe 101, an inner surface 11 formed on an inner side of the peripheral fringe 101, an outer surface 12 arranged on an outer side of the peripheral fringe 101, a first and a second ends 13, 14 disposed on two ends of the peripheral fringe 101 respectively, a slot 15 axially extending from the first end 13 to the second end 14 and allowing to be expanded resiliently and then recovery its original shape. The inner and the outer surfaces 11, 12 include at least one first deformable area and at least one second deformable area respectively to generate a deformation when being forced in a radial direction. As shown in FIG. 7, a dotted portion represents a profile before the inner and the outer surfaces 11, 12 are forced, and a solid portion denotes a profile after the inner and the outer surfaces 11, 12 are forced. As illustrated in FIG. 7, the first and the second deformable areas generate a radial-direction deformation to act against a radial-direction engaging force resulting from connecting the engaging member 10 and body 20 together.

The inner surface 11 of the engaging member 10 includes a plurality of first raised sections 111 spaced apart from each other and a number of first recessed sections 112 spaced apart from each other, and the first raised section 111 is connected with the first recessed section 112, wherein there are ten first raised sections 111 and ten first recessed sections 112 provided in this embodiment.

The outer surface 12 of the engaging member 10 includes a plurality of second raised sections 121 spaced apart from each other and a number of second recessed sections 122 spaced apart from each other, and the second raised section 121 is connected with the second recessed section 122, wherein there are ten second raised sections 121 and ten second recessed sections 122 provided in this embodiment.

The first raised section 111 is in response to the second recessed section 122, and the first recessed section 112 corresponds to the second raised section 121, wherein the first raised sections 111 are formed the first deformable area of the inner surface 11, and the second raised sections 121 are formed the second deformable area of the outer surface 12.

The first raised sections 111, the first recessed sections 112, the second raised sections 121, and the second recessed sections 122 of the engaging member 10 axially extend from the first end 13 to the end 14.

Figure 4:
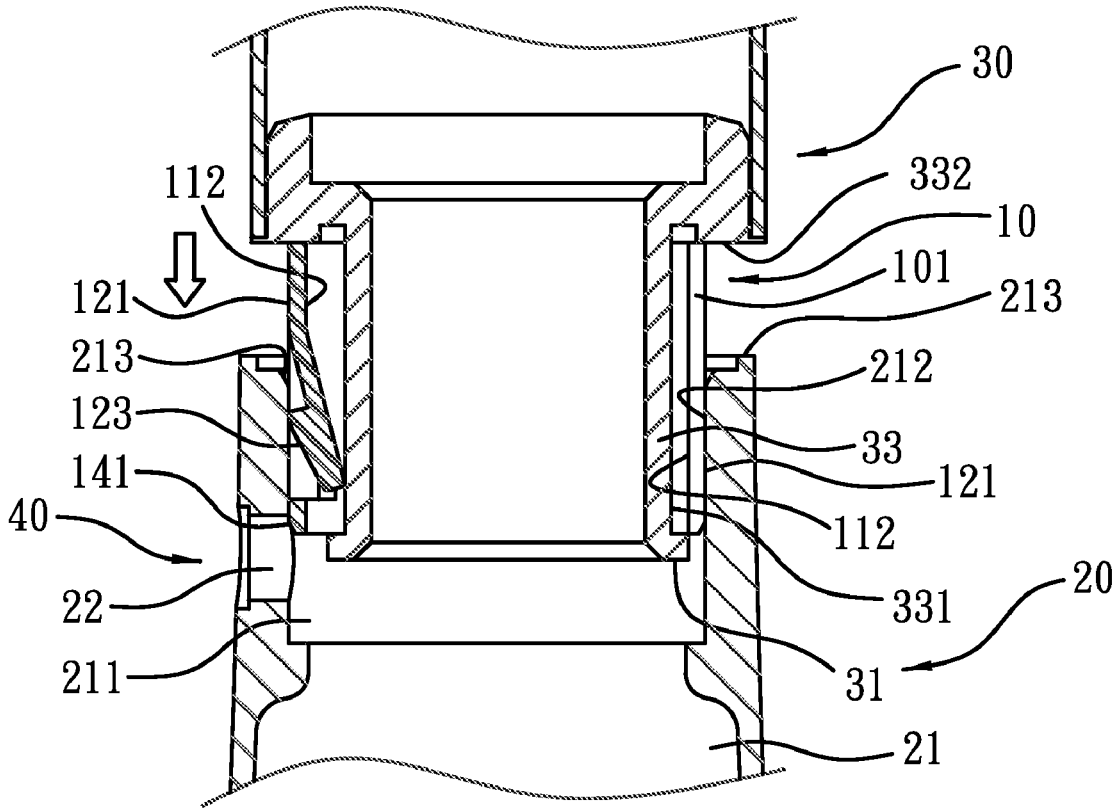
FIG. 4 is a cross sectional view showing a part of the assembly of the engaging member of the faucet connecting structure according to the first embodiment of the present invention.

One of the second raised sections 121 of the engaging member 10 adjacent to the second end 14 includes a post 123 radially extending thereon, and includes a U-shaped cutouts 124 arranged on two sides thereof individually to swing inward as being forced and to engage with the body 20 by using the post 123, hence when the post 123 is pressed, the first recessed section 112 in response to the second raised section 121 which includes the post 123 swings inward so that the engaging member 10 connects with the body 20 easily as shown in FIG. 4.

The slot 15 is capable of being arranged on a middle section of one of the second raised sections 121 as well or on one of the second recessed sections 122.

Figure 1:
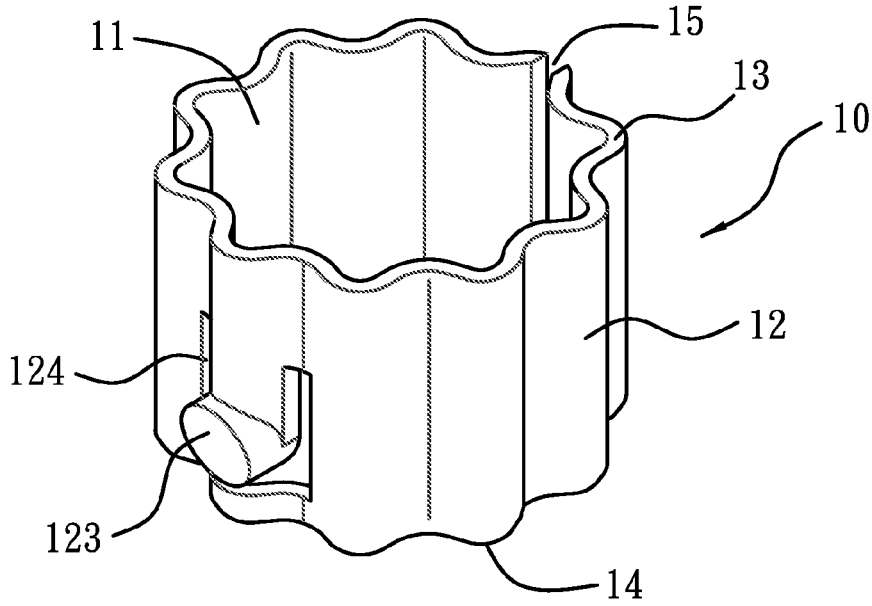
FIG. 1 is a perspective view showing the assembly of an engaging member of a faucet connecting structure according to a first embodiment of the present invention.
Figure 2:
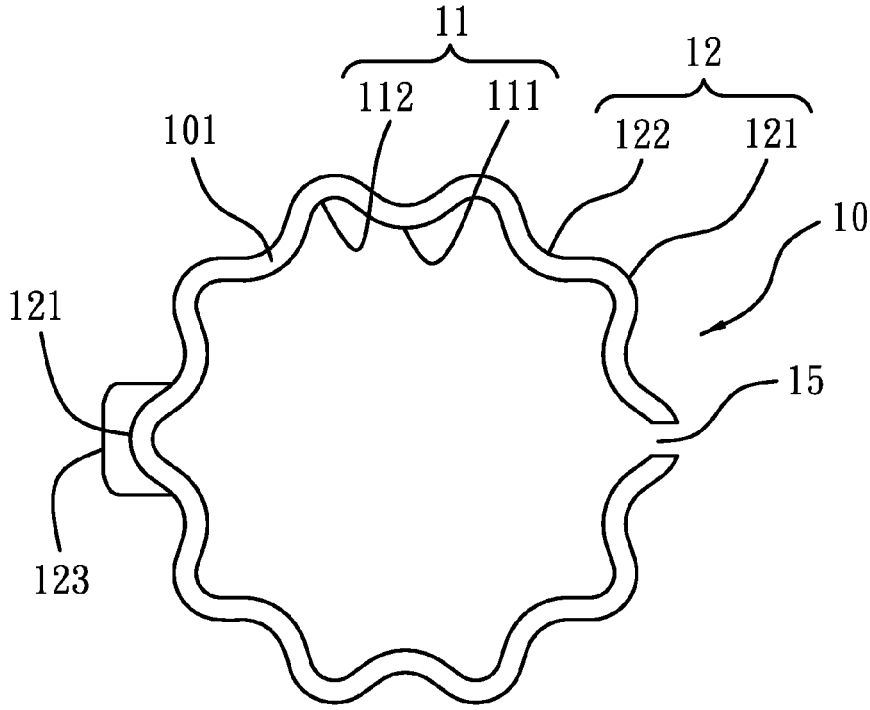
FIG. 2 is a top plan view showing the assembly of the engaging member of the faucet connecting structure according to the first embodiment of the present invention.

As illustrated in FIG. 2, the first raised sections 111 are formed in a convex arc shape, the first recessed sections 112 are formed in a concave arc shape, and the first raised sections 111 are connected with the first recessed sections 112 to form a regular wave profile. Also, the second raised sections 121 are formed in a convex arc shape, the second recessed sections 122 are formed in a concave arc shape, and the second raised sections 121 are connected with the second raised sections 121 to form a regular wave profile.

Figure 3:
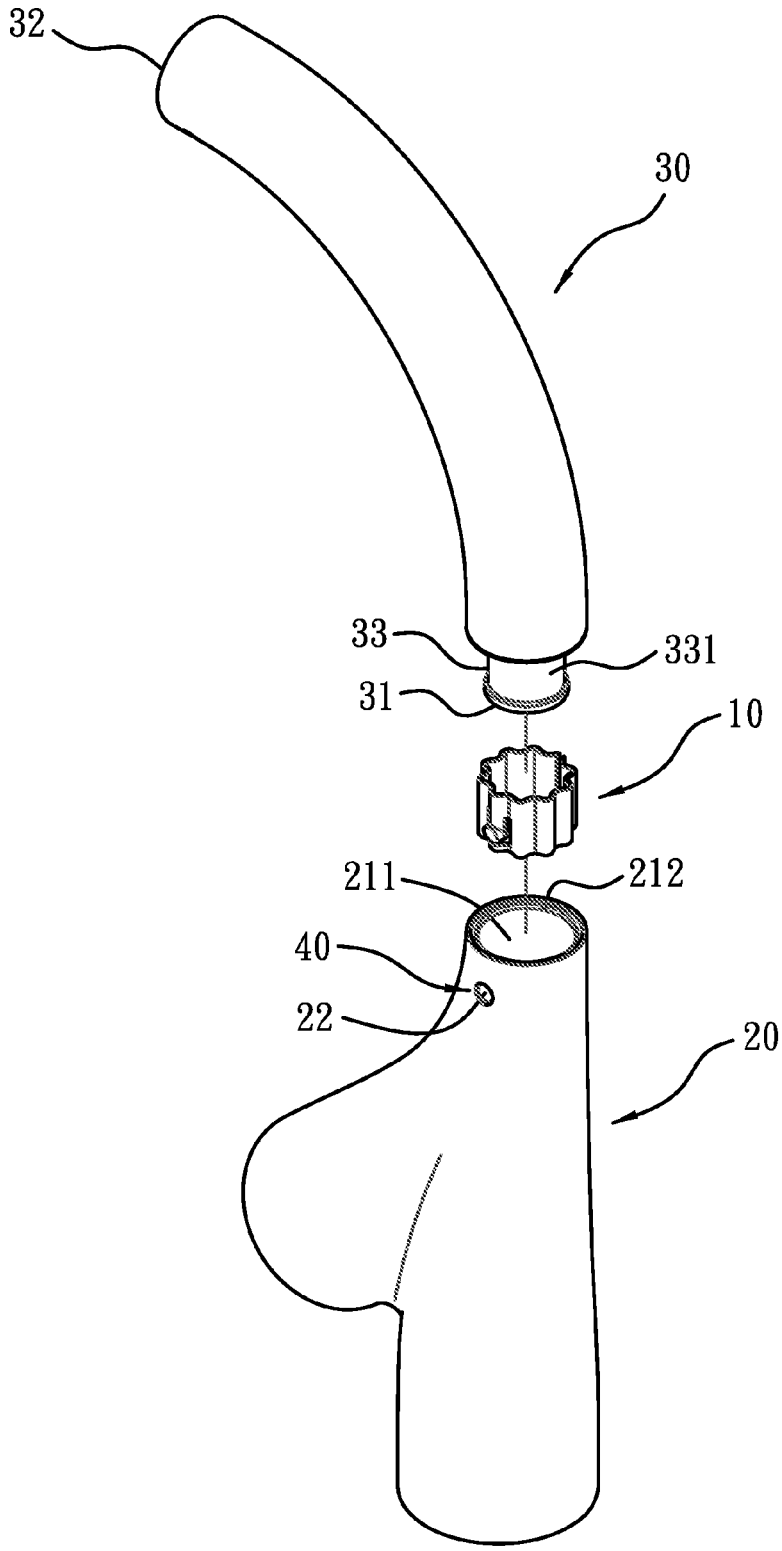
FIG. 3 is a perspective view showing the exploded components of the faucet connecting structure according to the first embodiment of the present invention.
Figure 6:
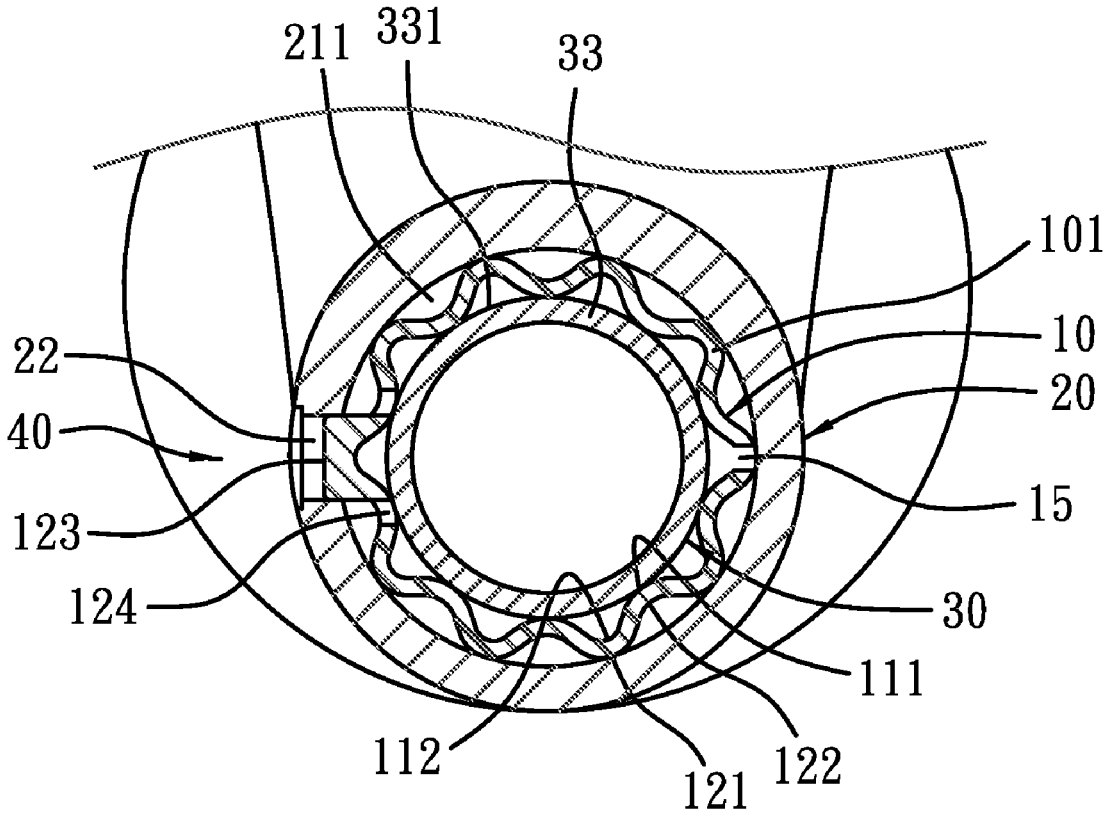
FIG. 6 is another cross sectional view showing a part of the assembly of the engaging member of the faucet connecting structure according to the first embodiment of the present invention.

It is to be noted that each first raised section 111 is capable of forming the first deformable area by using the second recessed section 122 to provide a deforming space so that when each first raised section 111 is forced by an internally radial force, it deforms flexibly and generates an inward radial-direction engaging force to act against a deformation. Likewise, each second raised section 121 is capable of forming the second deformable area by using the first recessed section 112 to provide another deforming space as shown in FIGS. 6 and 7 such that when each second raised section 121 is forced by an externally radial force, it deforms flexibly and generates an outward radial-direction engaging force to act against the deformation. Thereby, the inward and the outward radial-direction engaging forces to act against the deformations are applied to force an outer wall of the outlet pipe 30 and an inner wall of the body 20 as illustrated in FIGS. 3 and 4.

With reference to FIGS. 9-11 and 15, a difference of a faucet connecting structure of a second embodiment from that of the first embodiment of the present invention includes an engaging member 10*a*, and the engaging member 10*a* includes a plurality of first raised sections 111 in response to a number of second raised sections 121, and includes a plurality of first recessed sections 112 in response to a number of second recessed sections 122.

Figure 13:
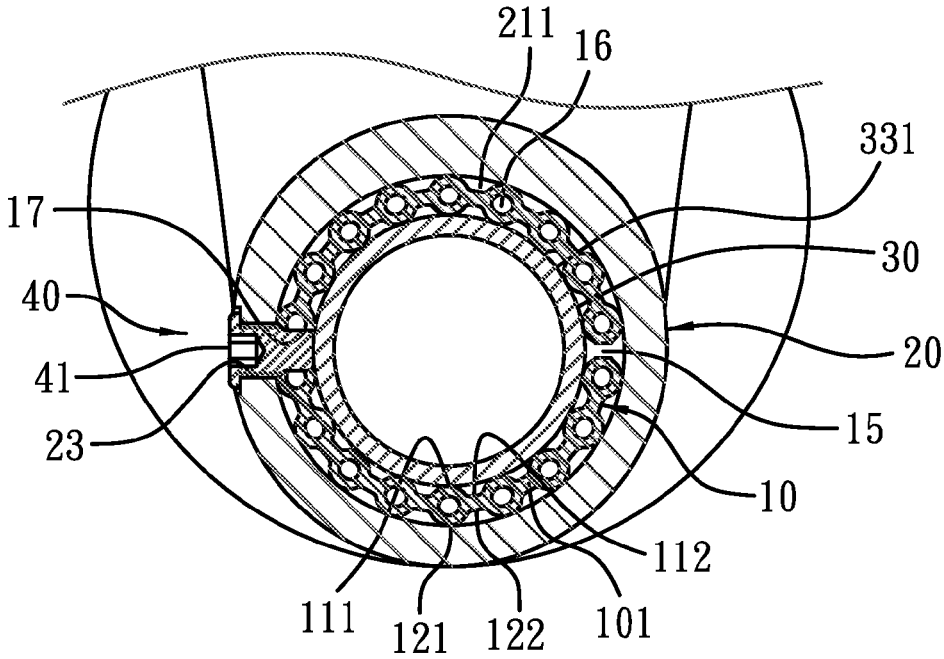
FIG. 13 is another cross sectional view showing a part of the assembly of the engaging member of the faucet connecting structure according to the second embodiment of the present invention.
Figure 14:
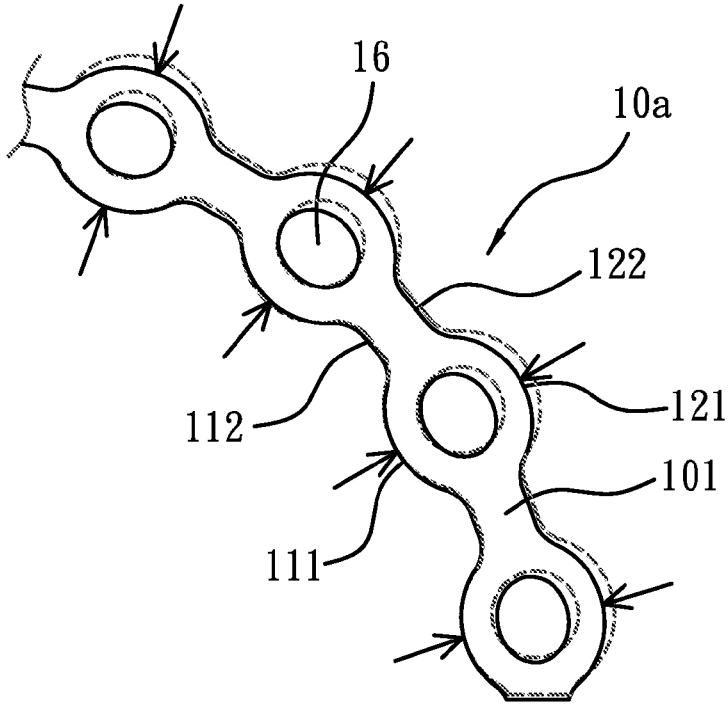
FIG. 14 is a plan view showing first and second deformable areas of the engaging member being forced to deform according to the second embodiment of the present invention.

Besides, the engaging member 10*a* includes a peripheral fringe 101 having a plurality of first deforming cavities 16 defined between the second raised sections 121 and the first raised sections 111, and each first deforming cavity 16 is a circular hole formed between a first end 13 of the peripheral fringe 101 and a second end 14 of the peripheral fringe 101 so that when the second raised sections 121 and the first raised sections 111 are forced by an outward and an inward radial forces individually, an enough deforming space is provided as illustrated in FIGS. 13 and 14, wherein a dotted portion represents a profile before the first raised sections 111 and the second raised sections 121 are forced, and a solid portion denotes a profile after the first raised sections 111 and the second raised sections 121 are forced, hence the first raised sections 111 are formed the first deformable area of the inner surface 11, and the second raised sections 121 are formed the second deformable area of an outer surface 12 to generate an inward and an outward radial-direction engaging forces to act against the deformations.

The outer surface 12 of the peripheral fringe 101 includes a positioning aperture 17 disposed between one of the second recessed sections 122 and one of the first recessed sections 112 to connect the engaging member 10*a* and a body 20 together.

Figure 16:
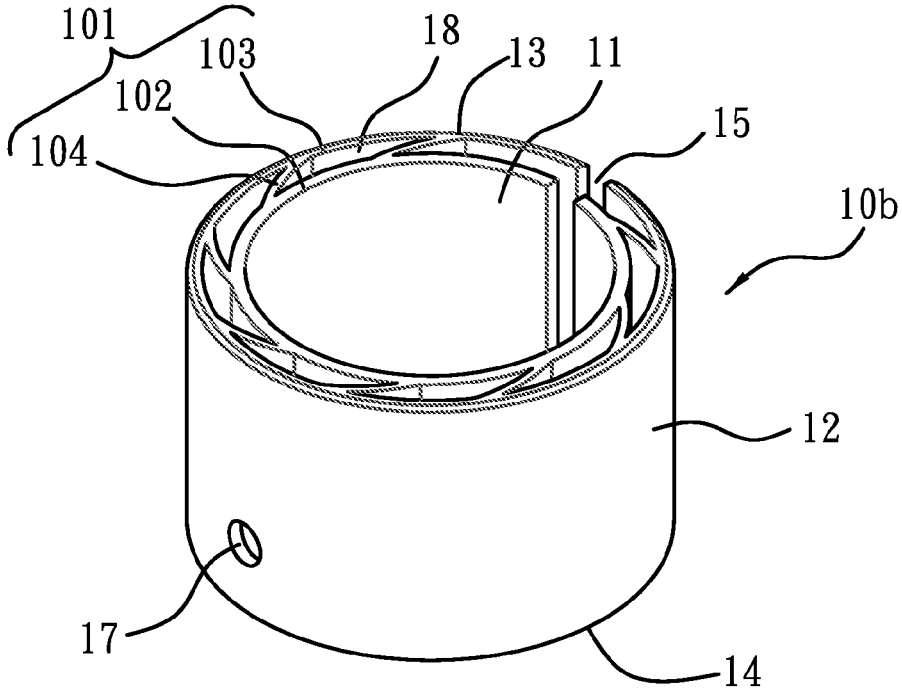
FIG. 16 is a perspective view showing the assembly of an engaging member of a faucet connecting structure according to a third embodiment of the present invention.
Figure 17:
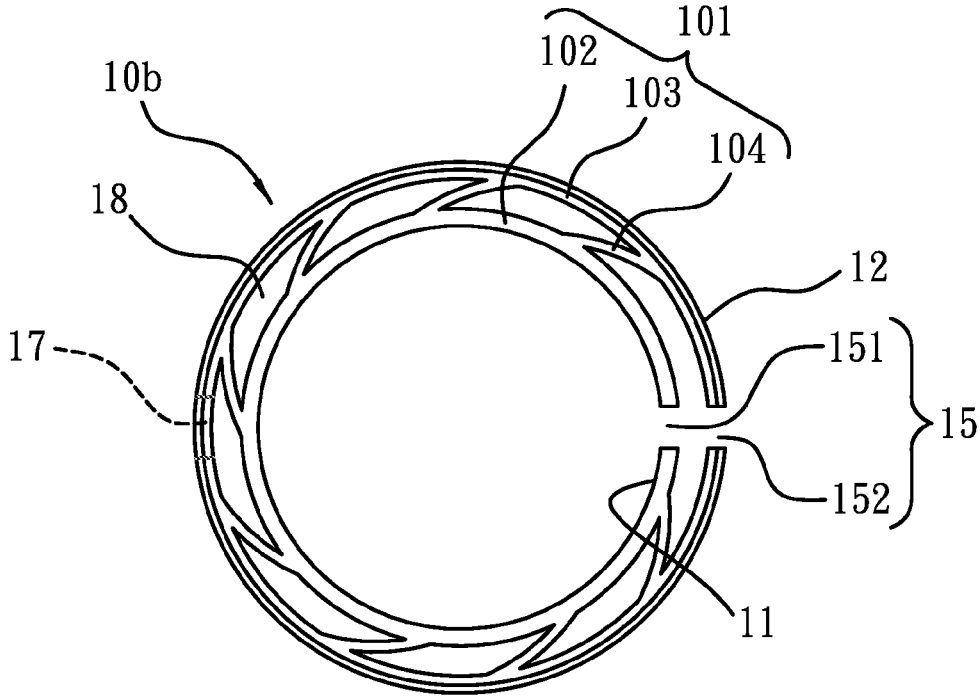
FIG. 17 is a top plan view showing the assembly of the engaging member of the faucet connecting structure according to the third embodiment of the present invention.

Referring FIGS. 16 and 17, a difference of a faucet connecting structure of a third embodiment from that of the second embodiment of the present invention includes an engaging member 10*b*, and the engaging member 10*b* includes an internally circular fence 102 and an external circular fence 103 integrally connected together by using a number of ribs 104, and among any two ribs 104, the internally circular fence 102, and the external circular fence 103 is defined a second deforming cavity 18, wherein the second deforming cavity 18 is rectangular and extends obliquely from a first segment 13 to a second segment 14, and the rib 104 extends axially from the first segment 13 to the second segment 14.

As illustrated in FIG. 17, an inner surface 11 is comprised of an inner side of the internally circular fence 102, and an outer surface 12 is comprised of an outer side of the external circular fence 103.

A peripheral fringe 101 of the faucet connecting structure of the third embodiment includes the internally circular fence 102 and the external circular fence 103, and the internally circular fence 102 and the external circular fence 103 include an inner gap 151 and an outer gap 152 respectively to form the slot 15 of the first embodiment. It is preferable that the inner gap 151 and the outer gap 152 allow to be fixed between two ribs 104 without passing through the rib 104, or there is no rib 104 provided between the inner gap 151 and the outer gap 152.

A positioning aperture 17 of the third embodiment is mounted on a suitable position of the external circular fence 103, such as a predetermined position of the external circular fence 103 where radially passes through two of the ribs 104.

Figure 19:
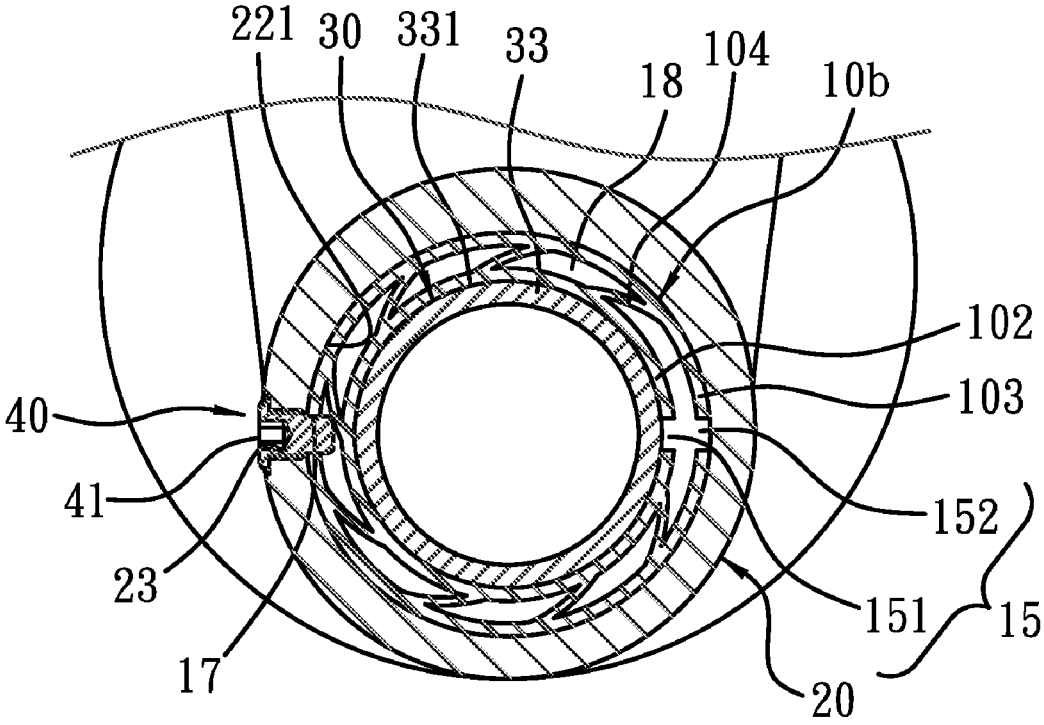
FIG. 19 is another cross sectional view showing a part of the assembly of the engaging member of the faucet connecting structure according to the third embodiment of the present invention.
Figure 20:
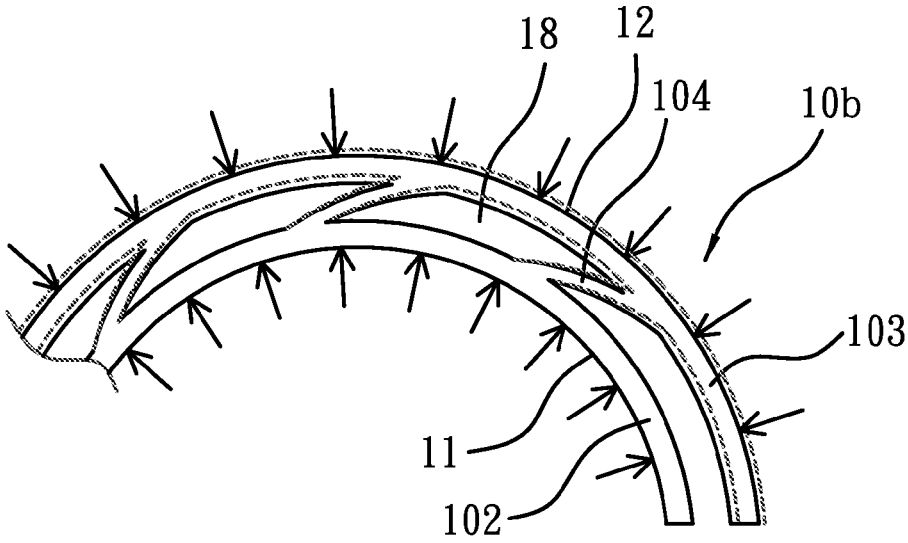
FIG. 20 is a plan view showing first and second deformable areas of the engaging member being forced to deform according to the third embodiment of the present invention.

Because the inner surface 11 and the outer surface 12 are flat, they are capable of serving as a first deformable area. In other words, when the inner surface 11 and the outer surface 12 are forced by an internally radial force and an externally radial force individually, they deform flexibly. As shown in FIGS. 19 and 20, a dotted portion represents a profile before the inner and the outer surfaces 11, 12 are forced, and a solid portion denotes a profile after the inner and the outer surfaces 11, 12 are forced. The first and the second deformable areas generate a radial-direction deformation to act against a radial-direction engaging force.

Figure 21:
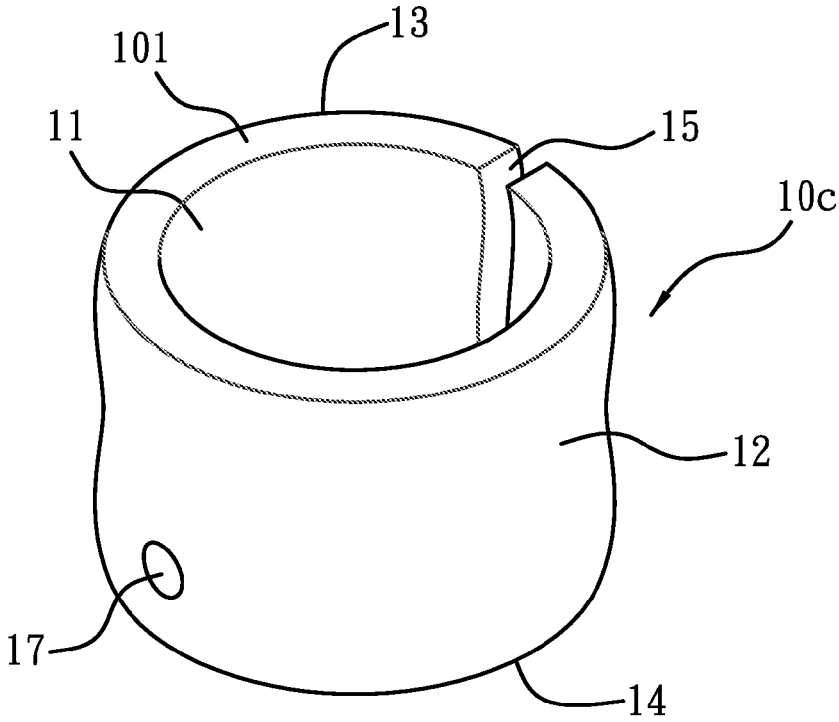
FIG. 21 is a perspective view showing the assembly of an engaging member of a faucet connecting structure according to a fourth embodiment of the present invention.
Figure 22:
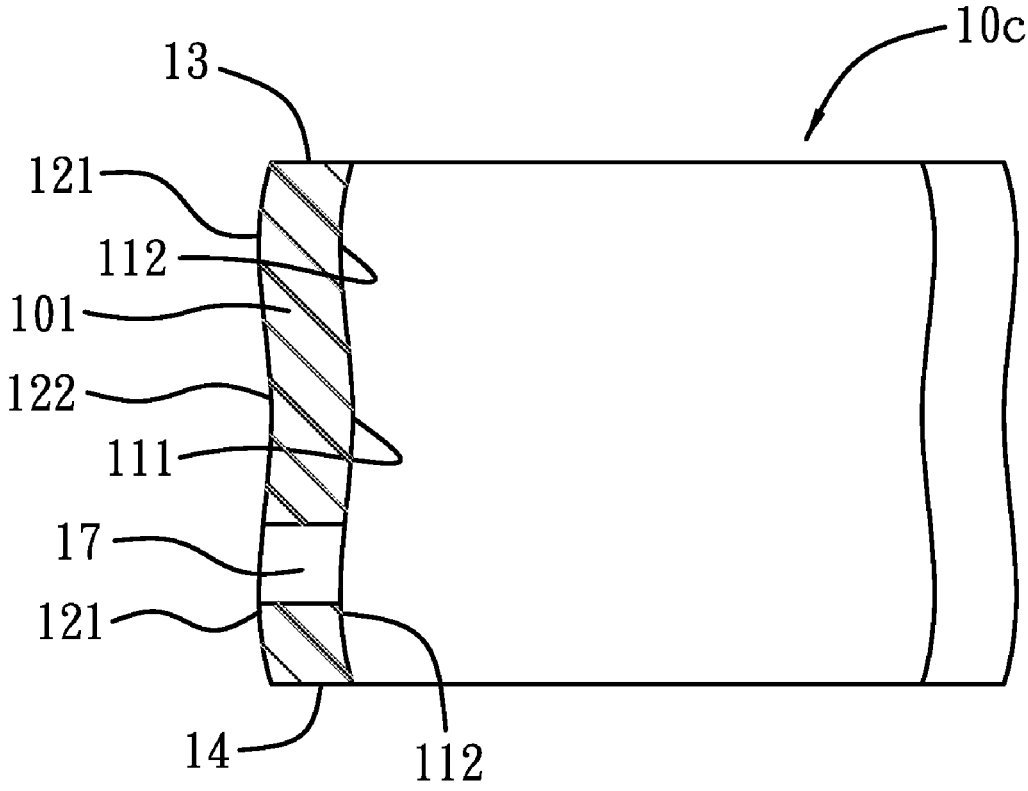
FIG. 22 is a cross sectional view showing the assembly of the engaging member of the faucet connecting structure according to the fourth embodiment of the present invention.
Figure 24:
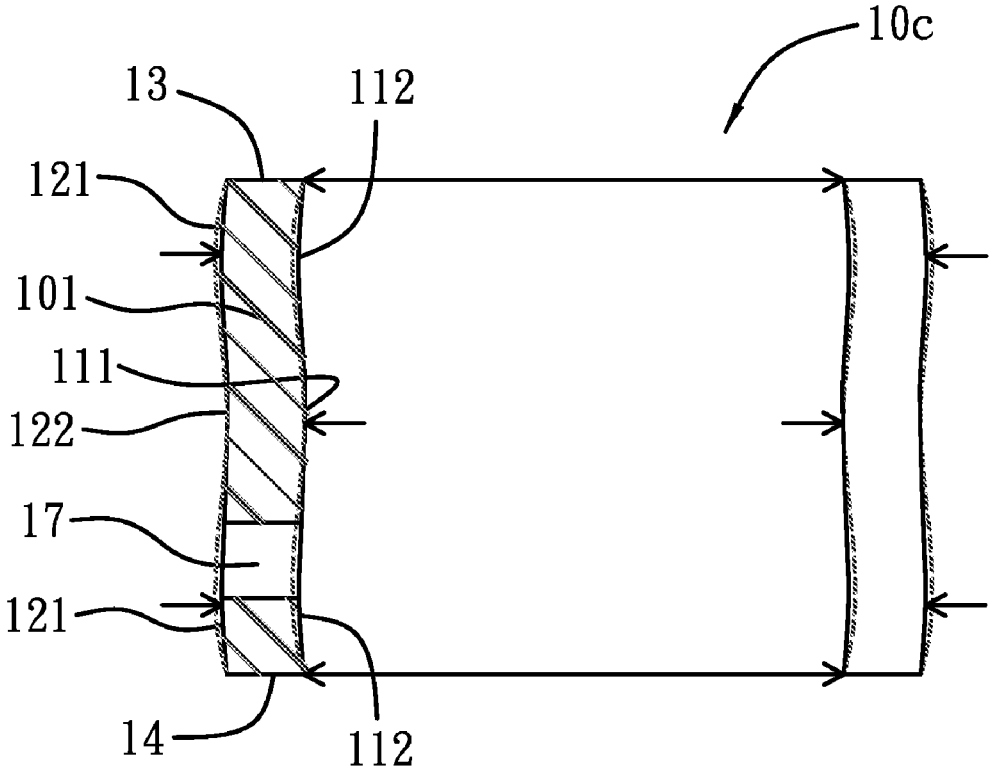
FIG. 24 is a cross sectional view showing first and second deformable areas of the engaging member being forced to deform according to the fourth embodiment of the present invention.

Referring FIGS. 21, 22, and 24, a difference of a faucet connecting structure of a fourth embodiment from that of the first embodiment of the present invention includes an engaging member 10*c*, and the engaging member 10*c* includes at least one second raised section 121 and at least one second recessed section 122, wherein the second raised section 121 and the second recessed section 122 are axially arranged on an outer surface 12, and the engaging member 10*c* also includes at least one first raised section 111 in response to the second recessed section 122 and at least one first recessed section 112 in response to the second raised section 121, wherein the first raised section 111 and the first recessed section 112 are axially arranged on the inner surface 11. Because only one of the second raised sections 121 and the first raised sections 111 is capable of being provided in this embodiment, the second raised section 121 is solely used to form the outer surface 12, and the first raised section 111 is solely used to form the inner surface 11.

The second raised section 121, the second recessed section 122, the first raised section 111, and the first recessed section 112 extend from one side of the slot 15 to another side of the slot 15 along a circumferential direction.

Figure 5:
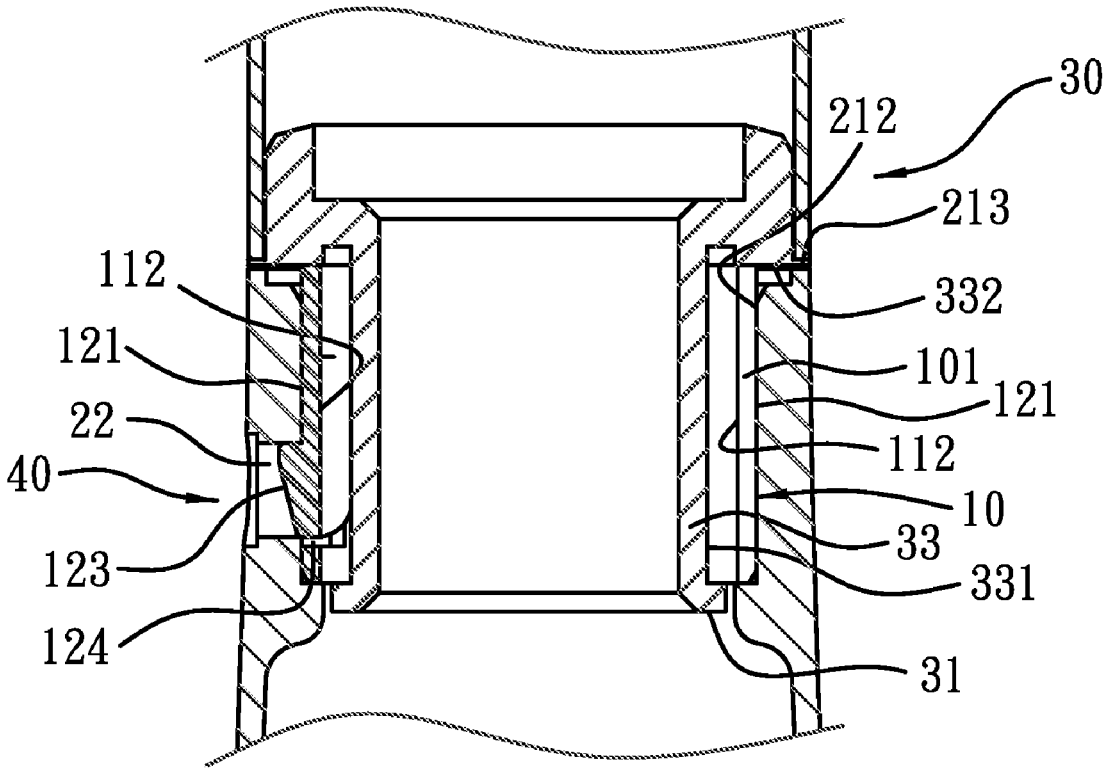
FIG. 5 is another cross sectional view showing a part of the assembly of the engaging member of the faucet connecting structure according to the first embodiment of the present invention.

As illustrated in FIGS. 3, 11, 18, and 23, the engaging members 10, 10*a*, 10*b*, 10*c* are connected with the body 20 and the outlet pipe 30, wherein the body 20, as shown in FIGS. 3 and 5, includes a chamber 21, and the chamber 21 includes a receiving trench 211 disposed on a top end thereof, the receiving trench 211 includes an opening 212 mounted on a top end thereof.

The outlet pipe 30 includes an inlet end 31 to input water and an outlet end 32 to output water, and the inlet end 31 includes a connector 33 to be inserted into the receiving trench 211 from the opening 212 of the body 20.

The engaging members 10, 10*a*, 10*b*, 10*c* are fitted, limited in a first recess 331 of the connector 33 of the body 20 by using the slot 15 and inserted in a second recess 211 of the body 20 as shown in FIGS. 4 and 5. Thereafter, the first and the second deformable areas of the inner surfaces 11 and the outer surfaces 12 of the engaging members 10, 10*a*, 10*b*, 10*c* are pressed by radial forces of the first recess 331 and the second recess 211 to cause a deformation so that the radial-direction engaging force generates to act against the deformation, hence the first recess 331 of the outlet pipe 30 and the second recess 211 of the body 20 contact with each other tightly along the radial direction as shown in FIGS. 6, 13, 19, and 23. Thereby, the outlet pipe 30 is fixed securely to prevent from a vibration in relative to the body 20 when a user touches the outlet pipe 30.

It is to be noted that diameters of the first and the second deformable areas are larger than an inner diameter of the second recess 211 so that the radial-direction engaging force and the deformation generate effectively to connect the outlet pipe 30 with the body 20 tightly. On connecting corners of the second ends 14 of the engaging members 10, 10*a*, 10*b*, 10*c* and the outer surface 12 is provided a tilted or an actuate guiding surface 141 respectively, and the opening 212 of the receiving trench 211 includes a circularly beveled face 213 formed therein so as to guide the engaging members 10, 10*a*, 10*b*, 10*c* into the receiving trench 211.

Due to the engaging members 10, 10*a*, 10*b*, 10*c* are limited in the first recesses 331 of the outlet pipes 30 securely, only one retaining means 40 is applied to retain the engaging members 10, 10*a*, 10*b*, 10*c* and the bodies 20 together, thus limiting the outlet pipes 30 to move and rotate axially relative to the bodies 20.

To limit the outlet pipes 30 to move and rotate axially relative to the bodies 20, the engaging members 10, 10*a*, 10*b*, 10*c* include the retaining means 40 as flows.

The retaining means 40 of the engaging member 10 of the first embodiment includes a locking orifice 22 mounted on the body 20 relative to the receiving trench 211, and includes the post 123 fixed on the engaging member 10 as illustrated in FIG. 5. The post 123 is flexible to swing inward without stopping the engaging member 10 to be placed in the receiving trench 211 of the body 20 when it is pressed, and the post 123 aligns with the locking orifice 22 and returns its original position to further retain in the locking orifice 22, such that the engaging members 10 retains with the body 20 to limit the outlet pipes 30 to move and rotate axially relative to the bodies 20.

Figure 12:
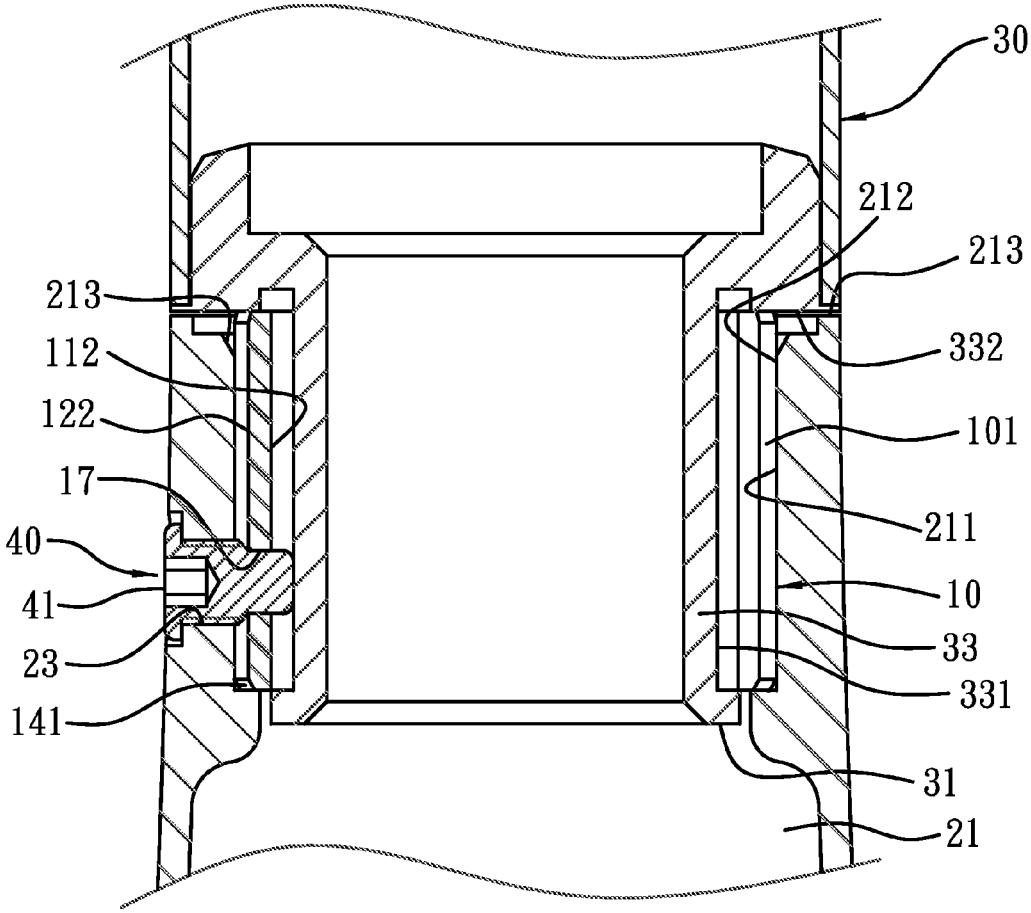
FIG. 12 is a cross sectional view showing a part of the assembly of the engaging member of the faucet connecting structure according to the second embodiment of the present invention.
Figure 15:
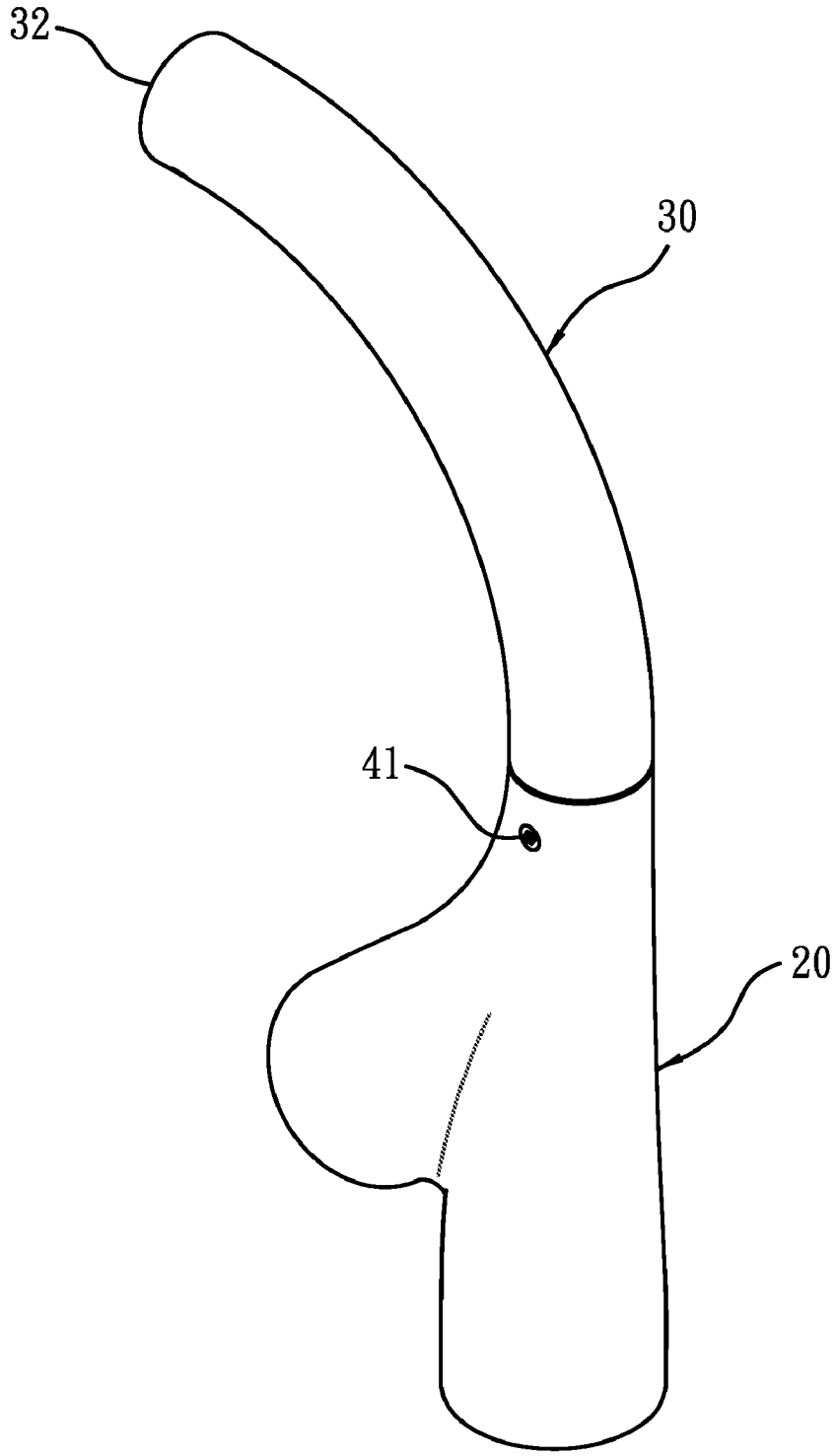
FIG. 15 is a perspective view showing the assembly of the faucet connecting structure according to the second embodiment of the present invention.

The retaining means 40 of the engaging member 10*a* of the second embodiment includes the positioning aperture 17, and a bore 23 secured on the body 20 relative to the receiving trench 211, and a fixing bolt 41 as illustrated in FIGS. 12 and 15. While the engaging member 10*a* inserts in the receiving trench 211 of the body 20 with the connector 33, the fixing bolt 41 screws with the bore 23 of the body 20 so that its distal end inserts into the positioning aperture 17 of the engaging member 10*a*, and the engaging member 10*a* retains with the body 20.

Figure 18:
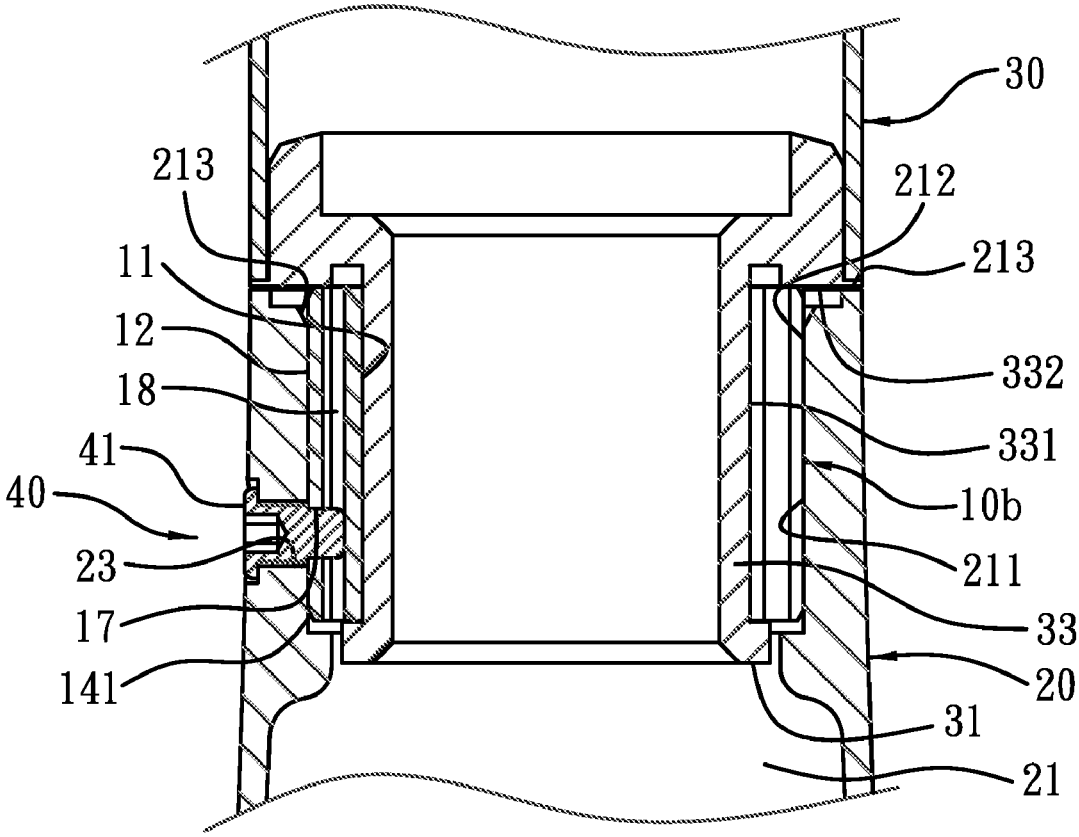
FIG. 18 is a cross sectional view showing a part of the assembly of the engaging member of the faucet connecting structure according to the third embodiment of the present invention.

The retaining means 40 of the engaging member 10*b* of the third embodiment includes the positioning aperture 17, a bore 23 secured on the body 20 relative to the receiving trench 211, and a fixing bolt 41 to retain with the positioning aperture 17 as illustrated in FIG. 18.

Figure 23:
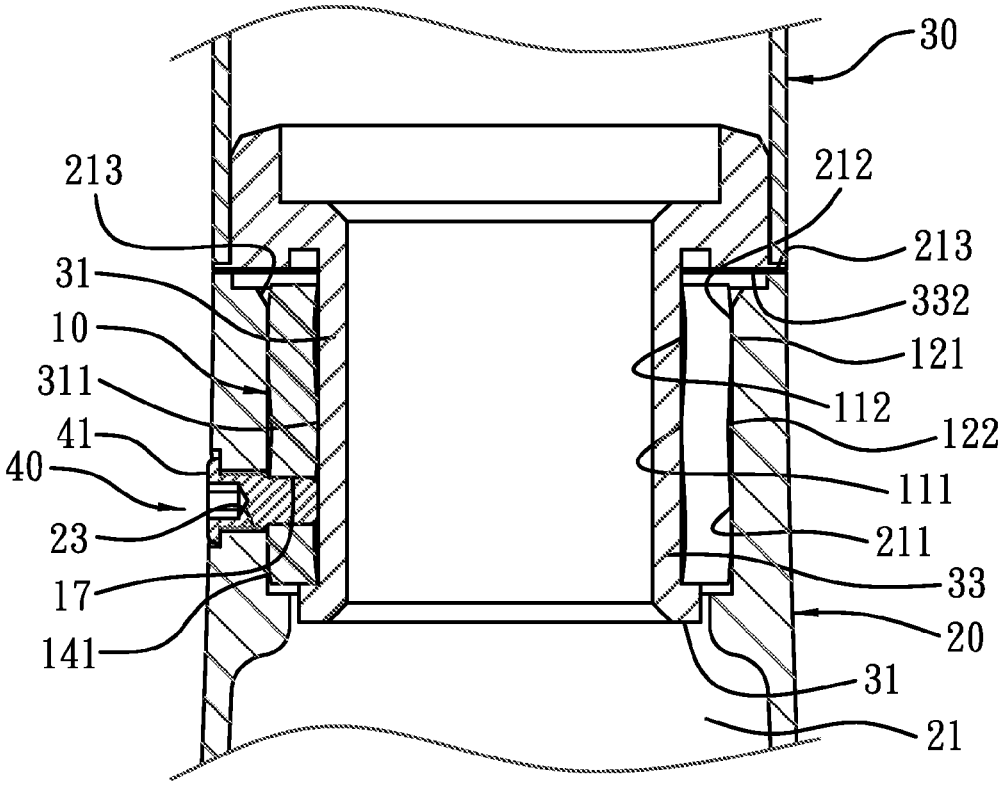
FIG. 23 is a cross sectional view showing a part of the assembly of the engaging member of the faucet connecting structure according to the fourth embodiment of the present invention.

The retaining means 40 of the engaging member 10*c* of the fourth embodiment includes the positioning aperture 17, and a bore 23 secured on the body 20 relative to the receiving trench 211, and a fixing bolt 41 to screw with the bore 23 and to retain with the positioning aperture 17 as illustrated in FIG. 23.

Thereby, the engaging members 10, 10*a*, 10*b*, 10*c* are forced to deform flexibly so as to eliminate a slit between the body 20 and the outlet pipe 30 and to connect the body 20 and the outlet pipe 30 tightly, therefore a working precision of related components for matching with the body 20 and the outlet pipe 30 are lowered to decrease production cost.

The engaging members 10, 10*a*, 10*b*, 10*c* are used to connect the body 20 and the outlet pipe 30 together without using a welding method so as to enhance aesthetics appearance and to facilitate disassembly.

The retaining means 40 serves to retain the outlet pipes 30 on the engaging members 10, 10*a*, 10*b*, 10*c* so that the outlet pipes 30 do not vibrate and are prevented from moving and rotating axially relative to the bodies 20, thus connecting the outlet pipes 30 and the body 20 together securely.

While we have shown and described various embodiments in accordance with the present invention, it is clear to those skilled in the art that further embodiments may be made without departing from the scope of the present invention.

What is claimed is:

1. A faucet connecting structure comprising:

a body including a chamber, and the chamber including a receiving trench disposed on a top end thereof, the receiving trench including an opening mounted on a top end thereof;

an outlet pipe including an inlet end to input water and an outlet end to output water, and the inlet end including a connector to be inserted into the receiving trench from the opening of the body, the connector including a first recess formed thereon;

an engaging member made of flexible material and including a peripheral fringe, an inner surface formed on an inner side of the peripheral fringe, an outer surface arranged on an outer side of the peripheral fringe, a first and a second ends disposed on two ends of the peripheral fringe respectively, a slot axially extending from the first end to the second end and allowing to be expanded resiliently and then recovery its original shape, the inner and the outer surfaces including at least one first deformable area and at least one second deformable area respectively to generate a radial-direction deformation when being forced in a radial direction so as to act against a radial-direction engaging force resulting from connecting the first engaging member and body together;

a retaining means to retain the engaging member and the body together so that the outlet pipe is limited to move and rotate axially relative to the body;

wherein the inner surface of the engaging member includes a plurality of first raised sections spaced apart from each other and a number of first recessed sections spaced apart from each other, and the plurality of first raised sections are connected with the first number of recessed sections;

the outer surface of the engaging member includes a plurality of second raised sections spaced apart from each other and a number of second recessed sections spaced apart from each other, and the second raised sections are connected with the number of second recessed sections;

the plurality of first raised sections correspond to the number of second recessed sections, and the plurality of first recessed section correspond to the number of second raised sections, wherein the plurality of first raised sections form the first deformable area of the inner surface, and the number of second raised sections form the second deformable area of the outer surface;

wherein the plurality of first raised sections, the number of first recessed sections, the plurality of second raised sections, and the number of second recessed sections of the engaging member axially extend from the first end to the second end;

wherein the retaining means includes a locking orifice mounted on the body relative to the receiving trench, and includes a post fixed on the engaging member to swing flexibly; and the engaging member retains with the body by retaining the post with the locking orifice of the body;

one of the plurality of second raised sections adjacent to the second end includes the post radially extending thereon, and includes a U-shaped cutout arranged on two sides thereof to swing inward as being forced and to engage with the body by using the post.

2. The faucet connecting structure as claimed in claim 1, wherein the slot is arranged on a middle section of one of the second raised sections.

* * * * *